US010710153B2

(12) United States Patent
Uchida et al.

(10) Patent No.: US 10,710,153 B2
(45) Date of Patent: Jul. 14, 2020

(54) METHOD FOR FILLING WITH METALLIC SODIUM

(71) Applicants: NITTAN VALVE CO., LTD., Kanagawa (JP); SUKEGAWA ELECTRIC CO., LTD., Ibaraki (JP)

(72) Inventors: Shigeru Uchida, Kanagawa (JP); Ryo Onose, Kanagawa (JP); Koichi Homma, Kanagawa (JP); Kuniaki Miura, Ibaraki (JP); Masashige Hanawa, Ibaraki (JP)

(73) Assignees: NITTAN VALVE CO., LTD., Kanagawa (JP); SUKEGAWA ELECTRIC CO., LTD., Ibaraki (JP)

( * ) Notice: Subject to any disclaimer, the term of this patent is extended or adjusted under 35 U.S.C. 154(b) by 231 days.

(21) Appl. No.: 16/072,617

(22) PCT Filed: Jan. 29, 2016

(86) PCT No.: PCT/JP2016/052636
§ 371 (c)(1),
(2) Date: Jul. 25, 2018

(87) PCT Pub. No.: WO2017/130376
PCT Pub. Date: Aug. 3, 2017

(65) Prior Publication Data

US 2019/0030595 A1 Jan. 31, 2019

(51) Int. Cl.
*B22D 23/00* (2006.01)
*B22D 27/00* (2006.01)
(Continued)

(52) U.S. Cl.
CPC ..... *B22D 23/06* (2013.01); *B22D 17/007* (2013.01); *B22D 23/00* (2013.01); *C22B 26/10* (2013.01);
(Continued)

(58) Field of Classification Search
CPC ..... B22D 23/06; B22D 27/045; B22D 37/00; F01L 3/02; F01L 3/12; F01L 3/14; B21K 1/22
See application file for complete search history.

(56) References Cited

U.S. PATENT DOCUMENTS 3,826,301 A * 7/1974 Brooks ..... B21J 5/00 164/46
5,346,184 A * 9/1994 Ghosh ..... B22D 27/08 164/46
5,381,847 A * 1/1995 Ashok ..... B22F 3/115 164/46

FOREIGN PATENT DOCUMENTS

JP 63033167 A * 2/1988
JP 03-018605 A 1/1991
(Continued)

OTHER PUBLICATIONS

Machine Translation of Mori et al (JP 04-232318A, published Aug. 20, 1992, cited in IDS filed Jul. 28, 2018). (Year: 1992).*

*Primary Examiner* — Kevin E Yoon
*Assistant Examiner* — Jacky Yuen
(74) *Attorney, Agent, or Firm* — Roberts Calderon; Safran & Cole P.C.

(57) ABSTRACT

Provided is a method for filling a stem-side hollow area of an engine valve with metallic sodium. The method includes injecting melted metallic sodium into a cylinder having a larger diameter than an inner diameter of the hollow area of the engine valve, forming a solidified metallic sodium rod having a substantially uniform structure in the cylinder, inserting the metallic sodium into the hollow area of the engine valve through a nozzle having a small diameter, and sealing the engine valve.

11 Claims, 4 Drawing Sheets

(51) Int. Cl.

| | |
|---|---|
| ***F01L 3/14*** | (2006.01) |
| ***B21K 1/22*** | (2006.01) |
| ***C22B 26/10*** | (2006.01) |
| ***B22D 23/06*** | (2006.01) |
| ***F01L 3/24*** | (2006.01) |
| ***B22D 17/00*** | (2006.01) |
| ***F01L 3/02*** | (2006.01) |

(52) U.S. Cl.
CPC ..... *F01L 3/02* (2013.01); *F01L 3/14* (2013.01); *F01L 3/24* (2013.01); *B21K 1/22* (2013.01); *B22D 27/003* (2013.01); *F01L 2303/00* (2020.05)

(56) References Cited

FOREIGN PATENT DOCUMENTS

| | | | |
|---|---|---|---|
| JP | 04-232318 | A | 8/1992 |
| JP | 04-272413 | A | 9/1992 |
| JP | 2003-103355 | A | 4/2003 |
| JP | 2011-179327 | A | 9/2011 |
| JP | 2011-184260 | A | 9/2011 |
| JP | 2012-136978 | A | 7/2012 |

* cited by examiner

METHOD FOR FILLING WITH METALLIC SODIUM

CROSS-REFERENCE TO RELATED APPLICATIONS

The present application is a U.S. National Phase of PCT/JP2016/052636 filed on Jan. 29, 2016. The disclosure of the PCT Application is hereby incorporated by reference into the present Application.

TECHNICAL FIELD

The disclosure relates to a method for filling a hollow engine valve used for an internal combustion engine with metallic sodium.

BACKGROUND

An engine valve used for an internal combustion engine such as an automotive engine, particularly an exhaust valve, is exposed to high temperature. Accordingly, the engine valve is configured such that the stem thereof is hollow, and metallic sodium is enclosed in the hollow area of the stem. Metallic sodium to be enclosed is solid at room temperature. However, the melting point of metallic sodium is about 98° C. Thus, the metallic sodium is liquefied at relatively low temperature. Accordingly, when the valve is warmed by activating engine, the metallic sodium become liquid and is shaken in the valve stem owing to a vertical movement of the valve. Thereby, heat transferred from a combustion chamber to the valve head is transferred through the valve stem so as to dissipate to a water jacket of a cylinder head through a valve guide contacting with the valve stem. This prevents overheat of the combustion chamber. Moreover, since the specific gravity of metallic sodium is 0.97, i.e. less than that of water, the metallic sodium filled in the valve can contribute to light-weighting of the entire valve.

Metallic sodium has a strong deoxidizing action so that it deoxidizes water to generate hydrogen while the metallic sodium per se changes to sodium hydroxide. Therefore, in order to prevent the oxidization of metallic sodium and in order to be stably preserved for a long period of time, the metallic sodium is stored under the condition where it is immersed in an organic solvent, such as kerosene, liquid paraffin (a mixture of relative long-chain saturated hydrocarbons, having a boiling point of several hundred degrees) or the like, with blocking water and air. Further, each of kerosene and liquid paraffin has a less specific gravity than metallic sodium, so that metallic sodium is securely blocked from water and air without floating on the surface of such solvents.

Filling the valve stem of the engine valve with such metallic sodium stored in the organic solvent is performed by taking out a bulk body of metallic sodium immersed in the organic solvent from the solvent, melting the metallic sodium, pouring the metallic sodium in a melting state into the stem of the engine valve, and then cooling the valve (Patent Document 1). Or, it is performed by ejecting melted metallic sodium linearly into a hydrocarbon liquid to solidify in a rod shape, and thereafter inserting the metallic sodium rod into the hollow area of the engine valve to be sealed (see FIGS. 2 and 4 of Patent Document 2).

RELATED ART DOCUMENT(S)

Patent Document

[Patent Document 1] Japanese Patent Application Laid-Open 2012-136978

[Patent Document 2] Japanese Patent Application Laid-Open 2011-179327

SUMMARY

Technical Problem

Generally, when melted metallic sodium is filled in an engine valve, it is highly desirable that constant amounts of melted metallic sodium be continuously filled into the stems of a large number of, for example, several hundreds of, engine valves to complete filling in a short time. However, it has not been possible with conventional arts to melt a commercially available metallic sodium bulk to fill the stem portions having inner diameters of about 2 to 4 mm with a constant amount of the melted metallic sodium.

That is, there is disclosed in the example shown in FIG. 4 of Patent Document 1 that melted metallic sodium contained in the quantitative metallic sodium tank 16 is supplied into an engine valve 11 through a supply pipe whose lower end portion is located in the engine valve 11. The hollow stem portion of the engine valve to be filled with the metallic sodium is an elongated hollow area having a diameter of about 2 to 4 mm. In the case where a metallic sodium supply pipe having a diameter smaller than the elongated hollow area is inserted into the elongated hollow area and the metallic sodium is tried to be supplied to the stem hollow area of the engine valve through the supply pipe, the metallic sodium is in a melting state in the metallic sodium supply pipe, if the hollow engine valve is preheated to above the melting point of metallic sodium so that melted metallic sodium cannot be solidified, it is possible to inject the metallic sodium without solidification. However, the metallic sodium is easier to oxidize as the temperature becomes higher. So, it is inevitable to keep the temperature of the hollow engine valve as low as possible below the melting point of metallic sodium. In this case, it is difficult to pass the metallic sodium through the small diameter supply pipe without clogging. Moreover, unless air corresponding to the volume of the supplied metallic sodium is taken out to the outside, the metallic sodium is oxidized so that the filling cannot be smoothly carried out.

The method disclosed in Patent Document 2 includes a step of extruding melted metallic sodium linearly into a hydrocarbon liquid to solidify the metallic sodium into a rod shape. It is extremely difficult to insert the metallic sodium which is once solidified to be molded in a rod shape having a small diameter directly into the engine valve with a small diameter to fill the engine valve since the metallic sodium is soft and easily bent.

In order to achieve a constant-amount filling, it is preferable that the metallic sodium to be filled be directionally solidified to form uniform structure without pores. In other words, it is desirable not to solidify the whole metallic sodium at the same time, but to sequentially solidify the metallic sodium toward a certain direction. Generally, a melted material shrinks in volume as it solidifies. Thus, when the melted material is solidified from the entire outer periphery, the solidified object become in short supply in the central portion due to a solidification shrinkage, so that gaps (pores) are likely to occur, and, in some cases, air may be involved in the gaps (pores). The directional solidification can avoid such situation.

For example, if metallic sodium having defects such as gaps is filled into a hollow area of an engine valve through a nozzle with a small diameter, a first disadvantage may arise that differences in the weights of metallic sodium rods having the same volumes causes variations in the weights of metallic sodium rods filled in the hollow area. Further, a second disadvantage may arise that smooth filling becomes difficult when liquid phase and gaps exist in the supplied melted metallic sodium.

The present invention has been made in order to dissolve the disadvantages of the conventional arts that constant amount of metallic sodium cannot be filled in engine valves, though it were desirable. An object of the present invention is to provide a method for easily and surely filling a hollow area of an engine valve with a constant amount of metallic sodium.

Solution to Problem

In order to achieve the above object, a method for filling with metallic sodium according to a first aspect of the present invention is a method for filling a hollow area of a hollow engine valve with metallic sodium. The method includes injecting melted metallic sodium into a cylinder having a larger diameter than an inner diameter of the hollow area of the engine valve, forming a solidified metallic sodium rod having substantially uniform structure in the cylinder, inserting the metallic sodium rod into the hollow area of the engine valve through a nozzle shaped die having a small diameter with an extruding mechanism while keeping the uniform structure of the metallic sodium rod, cutting the metallic sodium rod; and sealing the engine valve.

(Functions) In accordance with the first aspect of the present invention, firstly melted metallic sodium is injected into a cylinder having a diameter larger than the inner diameter of a hollow area of engine valve so as to cause a directional solidification of the melted metallic sodium.

For example, it is assumed that the melted metallic sodium is dropped in droplets form at sufficient temporal intervals. In this case, firstly, a first droplet of the melted metallic sodium would be sufficiently cooled and solidified in the cylinder to be solid metallic sodium. Thereafter, a second droplet of the melted metallic sodium would come into contact with the upper surface of the solidified metallic sodium. Therefore, since the metallic sodium of the first melted droplet had already solidified, the solidified metallic sodium as a solid phase and the second melted droplet of the melted metallic sodium as a liquid phase would be brought into contact with each other. However, the second melted droplet of the melted metallic sodium solidifies quickly so that the first melted droplet and the second droplet would not fuse each other. As a result, even after the solidification of the second melted droplet, there would occur a discontinuity that a boundary occurs in the structure at the interface between the two phases. The boundary is peeled since the boundary is not fused. Further, for example, it is assumed that a first droplet of melted metallic sodium existed in the cylinder in the unsolidified state, and a second melting droplet were dropped on the unsolidified metallic sodium. In this case, gaps would be likely to form on a boundary surface of the first and second droplets due to air sucked from the liquid surface to which the second droplet impinges.

By contrast, for example, when a first droplet of metallic sodium exists in the cylinder in the state where the metallic sodium is in process of solidification but is not completely solidified, in other words, in a semi-solidified state, and a second droplet comes into contact with the semi-solidified metallic sodium (the first droplet). Thus, movement of the surface of the semi-solidified metallic sodium whose viscosity becomes high gets poor.

Consequently, the second melted droplet and the first melted droplet come into contact and fuse with each other, but not to mix with each other. This generates continuity between the metallic sodium of the first and second melted droplets. By repeating this by many times, a solid metallic sodium rod having a uniform structure is formed as a directionally solidified metallic sodium of the melted droplets in the cylinder. It should be noted that "semi-solidified state" may be observed not only when the melted metallic sodium is injected into the cylinder in a droplet form, but also when the melted metallic sodium is supplied by injecting at a speed slightly faster than a speed at which a droplet solidifies, in a form in which no discontinuity occurs. The condition where no discontinuity occurs is also included in the aspect.

In the injection (dripping) of the melted metallic sodium, the melted metallic sodium is injected into the cylinder having a predetermined inner diameter (for example, 20 to 40 mm). As the metallic sodium rod has a uniform structure, a certain length of the metallic sodium rod has a constant weight. Accordingly, containing the melted metallic sodium before being injected into the cylinder in a vertically long container with a constant inner diameter, detecting the liquid level of the melted metallic sodium in the container with a multiplicity of position sensors, and setting to supply an amount of the melted metallic sodium corresponding to a predetermined vertical length to the cylinder, enable formation of a constant amount of the metallic sodium in the cylinder without gaps.

Further, in accordance with the first aspect, the metallic sodium rod solidified in the cylinder is extruded into thin through a nozzle shaped die having a small diameter to be inserted in the form of line or wire into the hollow area of the engine valve having an inner diameter of about 2 to 4 mm. Then, the metallic sodium is cut, and the engine valve is sealed. The cylinder has a bottom, for example, formed of a detachable cap member. The cap member is attached during filling of the metallic sodium in the cylinder, and the cap member is detached after the metallic sodium is solidified to be the metallic sodium rod. And then, instead of the cap member, the nozzle shaped die, which is tapered, is attached. Positioned under the nozzle shaped die is the hollow area of engine valve in which the metallic sodium is inserted and enclosed. The metallic sodium rod is extruded downward with a piston-like pushing member and passed through the nozzle shaped die so that the metallic sodium becomes in a form of line or wire having a diameter corresponding to the inner diameter of the hollow area. Finally, a required length of the linear metallic sodium is inserted in the hollow area and cut, and the engine valve is sealed.

Since the inner diameter of the cylinder is configured to be larger than that of the hollow area, it is possible that the metallic sodium rod is prepared in the cylinder greater in volume than the metallic sodium enclosed in the hollow area. A single metallic sodium rod can be used to be inserted to be cut and enclosed in the hollow areas of relative many, generally hundreds of, engine valves through the nozzle shaped die.

According to an embodiment of the present invention, in the method for filling with metallic sodium according to the first aspect of the present invention, the melted metallic sodium may be injected into the cylinder while maintaining the semi-solidified state.

(Functions) In this embodiment, a preceding melted injection material in a semi-solidified state, that is, in a state where a solidification is in progress but not completed, is brought into contact with a subsequent melted injection material. As mentioned above, a semi-solidified surface of the semi-solidified metallic sodium and the subsequent melted injected material are brought into contact with and fuse each other so as not to mix each other. As a result, no gaps are formed between the metallic sodium of the preceding and subsequent melted injection materials, and continuity occurs.

According to another embodiment of the present invention, in the method for filling with metallic sodium according to anyone of the above embodiments, the melted metallic sodium may be injected into the cylinder by dripping.

In this embodiment, the melted metallic sodium to be injected into the cylinder is supplied in a droplet form so that the surface of the metallic sodium to be injected is maintained in a semi-solidified state.

According to still another embodiment of the present invention, in the method for filling with metallic sodium according to any one of the above embodiments, the inner diameter of the cylinder may be within the range of 20 mm to 50 mm, the temperature of the melted metallic sodium may be within the range of 180° C. to 250° C., and the injection speed may be within the range of 150 g/min to 300 g/min.

(Functions) In order to achieve a directional solidification of the melted metallic sodium in the cylinder, it is desirable that the inner diameter of the cylinder, the temperature of the metallic sodium to be supplied to the cylinder, and the injection speed of the melted metallic sodium be set to appropriate values. As the inner diameter of the cylinder is set larger, the volume of the metallic sodium rod is greater, so that the number of the engine valves whose hollow areas can be filled with the metallic sodium by a single metallic sodium rod is greater. However, when the inner diameter of the cylinder is larger, the solidifying condition (temperature) is different between in the vicinity of the inner wall of the cylinder and around the center of the cylinder. As a result, the metallic sodium around the center of the cylinder solidifies lastly so that it becomes hard to achieve the directional solidification from the lower position to the upper position. Although it may be influenced by other parameters, in order to achieve the directional solidification, the inner diameter of the cylinder is within the range of 10 mm to 80 mm, preferably, 20 mm to 50 mm.

During filling of the cylinder with the metallic sodium, it is enough that the metallic sodium is kept at least in a melting state. However, too high temperature makes the metallic sodium hardly to solidify, by contrast, the temperature which is too near the melting point make the metallic sodium solidify quickly and the temperature control is difficult. Thus, the temperature of the metallic sodium is set within the range of 120° C. to 300° C., preferably, 180° C. to 250° C.

The injection speed of the melted metallic sodium to be injected to the cylinder is an important parameter in order to achieve the directional solidification. As mentioned above, if the injection speed is too high, the metallic sodium exists in a melting state in the cylinder. So, gaps are likely to be formed due to volume contraction at the time of the solidification of the metallic sodium. On the other hand, if the injection speed it too low, the melted metallic sodium antecedently injected is solidified and thereafter the melted metallic sodium subsequently injected is brought into contact with the antecedently injected metallic sodium. So, the antecedently injected metallic sodium and the subsequently injected metallic sodium do not fuse each other and is discontinuous at a boundary surface, so that many layers may be formed.

According to the embodiments of the present invention, the filling operation is usually carried out under an inert gas atmosphere. However, there may exists small amount of air. In that case, the metallic sodium in a portion in contact with the inert gas atmosphere of a single layer is oxidized to form sodium oxide and the metallic sodium in the other portion in which sodium oxide is not formed remains unoxidized. The sodium oxide is relatively hard and hard to deform, whereas the metallic sodium is relatively soft and likely to deform. In the case where the laminate made of many layers of the sodium oxide and metallic sodium is extruded through a nozzle shaped die, the hard sodium oxide hardly passes through the nozzle shaped die due to great resistance. By contrast, the soft metallic sodium easily passes through the nozzle shaped die. Therefore, the magnitude of the resistance when the metallic sodium having a layered structure passes through the nozzle shaped die may make the smooth inserting and cutting difficult. Although it is influenced by other parameters, in order to achieve the directional solidification to avoid a gap formation and preferably to avoid formation of a layered structure, the injection speed of the melted metallic sodium is set within the range of 50 g/min to 500 g/min, preferably, 150 g/min to 300 g/min.

A second aspect of the present invention is a method for purifying metallic sodium including an organic solvent and filling a hollow engine valve with purified metallic sodium includes placing a metallic sodium in a melting tank which is sealed, heating the melting tank under reduced pressure to vaporize to remove the organic solvent coating the metallic sodium, injecting melted metallic sodium into a cylinder having a diameter larger than an inner diameter of the hollow area of the engine valve, forming a solidified metallic sodium rod having substantially uniform structure in the cylinder, inserting the metallic sodium rod into the hollow area of the engine valve through a nozzle shaped die having a small diameter while maintaining the uniform structure of the metallic sodium rod, cutting the inserted metallic sodium and sealing the engine valve.

The second aspect includes a step of purifying the metallic sodium to be used prior to filling of metallic sodium substantially same as in the first aspect, so that the purity of the metallic sodium to be filled in the hollow area of the engine valve is made higher. As mentioned above, metallic sodium is stored under the condition where the metallic sodium is immersed in an organic solvent, such as kerosene or liquid paraffin with blocking water and air.

The metallic sodium taken out of the organic solvent is coated with the kerosene or the liquid paraffin at the surface thereof. In the case where the metallic sodium is used for filling the hollow area of engine valve, it is desirable to increase the purity of the metallic sodium by removing such organic solvent prior to filling. For this reason, traditionally the metallic sodium has been used after such organic solvents is wiped from the surface of the metallic sodium.

However, on the surface of commercially available metallic sodium, some cracks may occur. Melting a bulk body of the metallic sodium with the cracks to form liquid metallic sodium causes inconveniences, for example, contamination by impurities such as kerosene, liquid paraffin. For this reason, traditionally, metallic sodium is melted to use after removing a portion around the cracks by cutting off. Thus, conventionally, first of all, a separate examination of the surface condition of each bulk body of the metallic sodium is performed. Then, when the surface condition is good, the metallic sodium is melted and purified after wiping out liquid paraffin or the like. When cracks occur on the surface, the metallic sodium is melted after cutting out the surface relatively thick. This method has drawbacks of requiring the examination for each metallic sodium ingot and time-consuming operation of cutting out the surface of the defective metallic sodium. This method also has a drawback of reducing a manufacturing yield of purified metallic sodium due to cutting-out of metallic sodium chips.

According to the second aspect, metallic sodium is placed in a sealed melting tank and is heated in the melting tank under reduced pressure to vaporize and remove the organic solvent to be highly purified metallic sodium. This configuration eliminates the need to individually inspect the surface condition of the metallic sodium as a material in contrast to conventional art. Thus, this configuration improves the operability and prevents the reduction of the yield of the metallic sodium due to cutting-out of the cracks.

Benefit of the Invention

With the first aspect of the present invention, melted metallic sodium is injected into a cylinder to directionally solidify to form a certain amount of a metallic sodium rod having substantially uniform structure. The solidified metallic sodium rod is surely and smoothly inserted into a hollow area of an engine valve through a nozzle shaped die having a small diameter. Then, the metallic sodium is cut and the engine valve is sealed. This enables, preferably continuous, insertion of a constant amount of the metallic sodium, cutting of the metallic sodium, and sealing the engine valve to fill a plurality of the engine valves. With the second aspect of the present invention, prior to the first aspect, the metallic sodium is purified. The metallic sodium having higher purity can be inserted into the engine valve, and it can be cut and enclosed.

DESCRIPTION OF THE EMBODIMENTS

An embodiment of the present invention will now be described with reference to the accompanying drawings but are not limited to.

Figure 1:
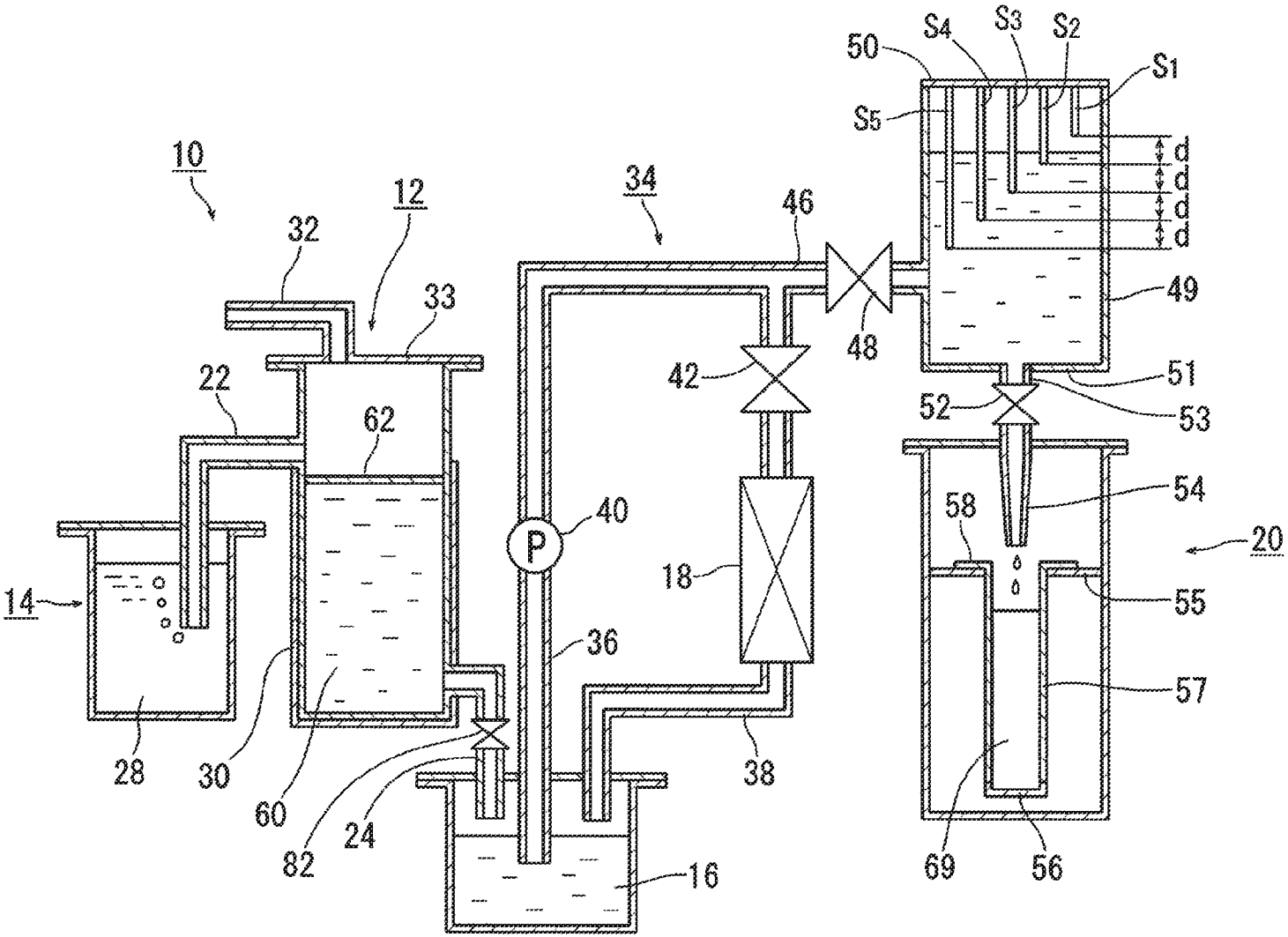
FIG. 1 is an entire constitution diagram illustrating a system for purifying metallic sodium and filling with the metallic sodium by inserting, cutting and enclosing the metallic sodium, according to an embodiment of the present invention.

The embodiment is illustrated as a series of systems for purifying unpurified metallic sodium in addition to for filling with the metallic sodium by inserting, cutting and enclosing the metallic sodium. However, the embodiment can be performed as a system only for filling with metallic sodium. As illustrated in FIG. 1, the system 10 for purifying and filling with metallic sodium mainly includes a melting tank 12, a solvent trap 14, a reservoir tank 16, a cold trap 18 and a filling device 20.

The melting tank 12 is a cylindrical container with a bottom. Connected to the upper side surface of the melting tank 12 is a pressure-reducing suction pipe 22. Connected to the lower side surface of the melting tank 12 are a purified-metallic-sodium discharge pipe 24 and a valve 82. The pressure-reducing suction pipe 22 is connected to the solvent trap 14 filled with an organic solvent 28 such as liquid paraffin. The tip end of the pressure-reducing suction pipe 22 reaches in the organic solvent 28. The solvent trap 14 is configured in such a manner as to keep inside thereof under reducing pressure by a decompression pump (not shown). The purified-metallic-sodium discharge pipe 24 is connected to the reservoir tank 16.

The melting tank 12 is provided with a heater 30 on entire side surface below the pressure-reducing suction pipe 22 and on the bottom surface. The melting tank 12 is sealed by fixing a lid 33 at an upper opening thereof and the lid 33 is connected with an inert-gas supply pipe 32.

The reservoir tank 16 is a closed tank for temporarily reserving purified metallic sodium which is purified in the melting tank 12 and which is supplied to the reservoir tank 16 through the purified-metallic-sodium discharge pipe 24. The reservoir tank 16 is connected with a feed pipe 36 and a return pipe 38 of a purified-sodium circulation line 34, in addition to the purified-metallic-sodium discharge pipe 24. The feed pipe 36 is branched into two at an opposite end to the end connected with a circulation pump 40. One of the two branches configures the other end of the return pipe 38 and is connected to the reservoir tank 16 through a first solenoid valve 42 and the cold trap 18.

The other of the two branches configures a filling device supply pipe 46. The supply pipe 46 is connected to a quantitative supply device 49 through a second solenoid valve 48. In the illustrated example, the lower surface of a top plate 50 of the quantitative supply device 49 is electrically connected with five liquid level detection sensors $S_1$ to $S_5$, each having different length. Differences in the lengths in the vertical direction between each pair of adjacent sensors are the same length of "d". The quantitative supply device 49 is connected with a supply pipe 53 having a quantitative supply valve 52 at the bottom plate 51. The supply pipe 53 extends to the filling device 20 and is equipped with a sodium dripping nozzle 54 at one end thereof. The filling device 20 is mounted inside thereof with a donut-shaped support 55 to come into contact with the inner circumferential surface of the filling device 20. The filling device 20 is equipped inside thereof with a cylinder 57 having a cylindrical shape with a flange 58. On the lower end of the flange 58, a cap 56 having a disk shape is detachably attached such that the flange 58 is engaged with a center opening of the support 55 located directly under the sodium dripping nozzle 54.

Next, a function of the system for purifying and filling with metallic sodium according to the embodiment, which has the configuration as mentioned above, will be described.

A suitable amount of liquid paraffin is put in the solvent trap 14 in FIG. 1, and the lid 33 of the melting tank 12 is taken off. A bulk body of unpurified metallic sodium that has been immersed and stored in the liquid paraffin is put in the melting tank 12 after wiping off the liquid paraffin with a cloth from the bulk body. Then, the lid 33 is attached again. Thereafter, by supplying an inert gas such as argon or nitrogen, from the inert-gas supply pipe 32, inside of the melting tank 12 is made under inert gas atmosphere so as to be sufficiently blocked from water and oxygen.

Then, by activating the decompression pump (not shown), insides of the solvent trap 14 and the melting tank 12 are made under reduced pressure. Heating the bulk body of the metallic sodium in the melting tank 12 by energizing the heater 30 allows the liquid paraffin coating the bulk body of the metallic sodium to vaporize to be introduced into the solvent trap 14. The liquid paraffin is absorbed into the liquid paraffin 28 in the solvent trap 14, and thus a purification of the metallic sodium is completed.

Even though a commercially available metallic sodium is stored in an organic solvent such as liquid paraffin or the like, it cannot be avoided that the commercially available metallic sodium contacts a small amount of water and oxygen, and it is oxidized at the surface to form sodium oxide. Likewise, a formation of sodium oxide by oxidization of the surface of the metallic sodium in this embodiment cannot be avoided even though a purification operation according to this embodiment is performed under inert gas atmosphere substantially including no water and no oxygen. The sodium oxide is formed as porous oxide so as to have bulk specific gravity less than that of metallic sodium. Accordingly, as illustrated in FIG. 1, the sodium oxide floats on the surface of the melted metallic sodium 60 to form a sodium oxide layer 62 when the metallic sodium in the melting tank is melted completely.

Due to the existence of the sodium oxide layer 62 on the surface of the melted metallic sodium 60, the melted metallic sodium 60 cannot come into contact with the atmosphere in the melting tank 12. Even if the liquid paraffin in the melted metallic sodium 60 tries to vaporize, it cannot escape from the melted metallic sodium 60, so that purification of the metallic sodium cannot proceed. In order to avoid such situation, the sodium oxide layer 62 on the surface of the melted metallic sodium 60 can be scooped manually or mechanically with the lid 33 taken off, or, for example as shown in FIG. 2, at least a part of the sodium oxide layer 62 can be broken by generating a forcible flow with a stir bar.

Figure 2:
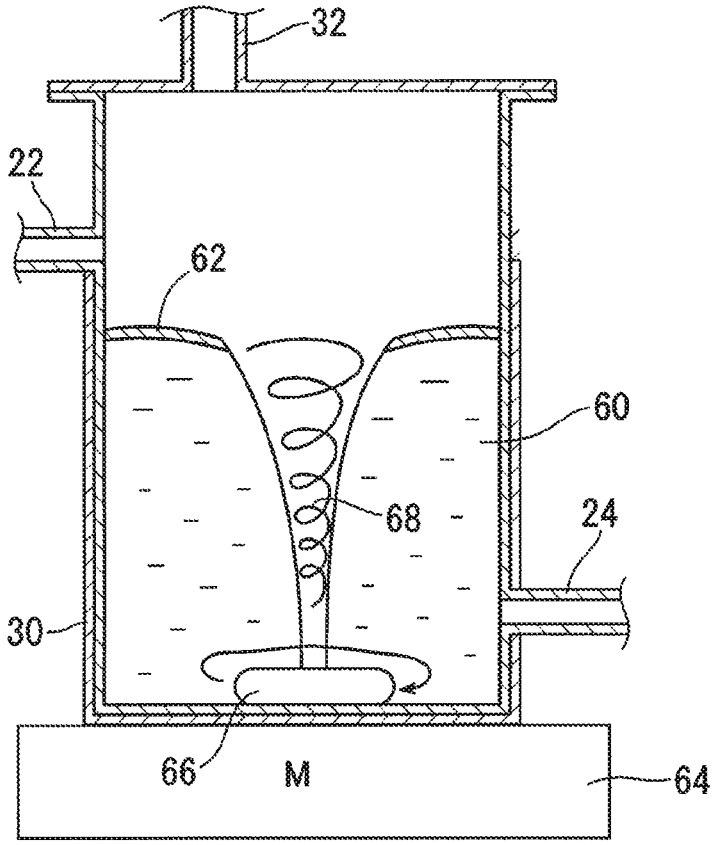
FIG. 2 is a vertical cross-section view of a modification of a melting tank shown in the entire configuration diagram of FIG. 1.

FIG. 2 is a vertical cross-section view of a modification of the melting tank in the entire constitution diagram of FIG. 1. The same components as FIG. 1 are denoted with the same numeral references and detailed descriptions thereof are omitted. In short, as shown in FIG. 2, a motor 64 is disposed to come into contact with a heater 30 in a lower part of a melting tank 12 and a stir bar 66 is set in the melting tank 12. By energizing a motor 64 during heating under reducing pressure, the stir bar 66 rotates in the melted metallic sodium 60 to generate a spiral flow 68 in the melted metallic sodium 60. The spiral flow 68 breaks at least a part of the sodium oxide layer 62 covering the entire surface of the melted metallic sodium 60, so as to make the melted metallic sodium 60 come into contact with the vaporization atmosphere inside the melting tank 12. Thus, removal of the liquid paraffin by vaporization can be achieved regardless of the presence or absence of the sodium oxide layer 62.

Thus, purified metallic sodium is supplied to the reservoir tank 16 from the melting tank 12 in FIG. 1 through a purified-metallic-sodium discharge pipe 24 by opening a valve 82. The purified metallic sodium is temporarily reserved in the reservoir tank 16. The purified metallic sodium in the reservoir tank 16 is supplied to the circulation line 34 through the feed pipe 36. Under an ordinary state, the first solenoid valve 42 is opened and the second solenoid valve 48 is closed. In this state, the melted metallic sodium supplied to the circulation line 34 is supplied to the cold trap 18 through the first solenoid valve 42. Impurities mainly composed of a metal oxide of sodium and the like are isolated by filtration with the cold trap 18, and the melted metallic sodium is returned to the reservoir tank 16 through the return pipe 38. The purity of the melted metallic sodium in the reservoir tank 16 is further improved by the melted metallic sodium circulating through the circulation line 34 for one or more times.

When it is required to load the cylinder 57 with the purified metallic sodium in the reservoir tank 16, the first solenoid valve 42 is closed and the second solenoid valve 48 is opened. This enables to supply the purified metallic sodium in a melting state from the feed pipe 36 to the quantitative supply device 49 through the filling device supply pipe 46. While the purified metallic sodium is being supplied to the quantitative supply device 49, a liquid level of the purified metallic sodium rises gradually. When the liquid surface of the melted metallic sodium comes into contact with the lower end of the first liquid-level detection sensor $S_1$ having the shortest vertical length, a detection signal is transmitted to the quantitative supply valve 52 and the second solenoid valve 48, so as to open the quantitative supply valve 52 and close the second solenoid valve 48. Thereby, supply of the melted metallic sodium to the quantitative supply device 49 is stopped, and the melted metallic sodium in the quantitative supply device 49 is supplied to the filling device 20 to be loaded into the cylinder 57 through the sodium dripping nozzle 54, for example, in a droplet form. This operation usually can be performed by self-weight of the melted metallic sodium, but it may be performed by applying a little positive pressure in the quantitative supply device 49 or applying a little negative pressure in the filling device 20.

When the liquid level of the melted metallic sodium in the quantitative supply device 49 lowers to reach to the lower end of the second liquid-level detection sensor $S_2$, the second liquid-level detection sensor $S_2$ detects the liquid level, so that the quantitative supply valve 52 is closed to stop supplying the purified metallic sodium. Thereby, the cylinder 57 is loaded with a predetermined amount of the purified metallic sodium, corresponding to the vertical length of "d" of the quantitative supply device 49. At that time, by properly determining an injection speed, the temperature of the metallic sodium in the sodium injection nozzle 54, and the amount of the purified metallic sodium to be supplied to the cylinder 57 (a diameter of a cylindrical body of the metallic sodium formed in the cylinder) and by performing injection under a directional solidification condition, a directionally solidified molded body of the purified metallic sodium having uniform structure without a gap can be provided.

Then, the cylinder 57 loaded with the predetermined amount of the metallic sodium is detached from the filling device 20 and replaced with a second cylinder ready to be loaded with the metallic sodium next. The melted metallic sodium in the quantitative supply device 49 is supplied to the second cylinder by opening the quantitative supply valve 52 again. When the liquid level of the metallic sodium coming into contact with the lower end of the third liquid-level detection sensor $S_3$ is detected, the quantitative supply valve 52 is closed again. Thereby, the second cylinder is loaded with the predetermined amount of the melted metallic sodium, corresponding to the vertical length of "d" of the quantitative supply device 49, in a similar manner to the above previous loading. By repeating such operations by predetermined times, a constant amount of the metallic sodium can be loaded to a predetermined plural number of the cylinders.

In this embodiment, the melting tank is intended for removal of the organic solvent such as liquid paraffin or the like, while the cold trap 18 is mainly intended for removal of metallic sodium oxide or the like. Accordingly, when it is intended to remove only the organic solvent and it is unnecessary to remove the metallic sodium oxide or the like, the cold trap 18 and accompanying equipment are unnecessary.

Figure 3:
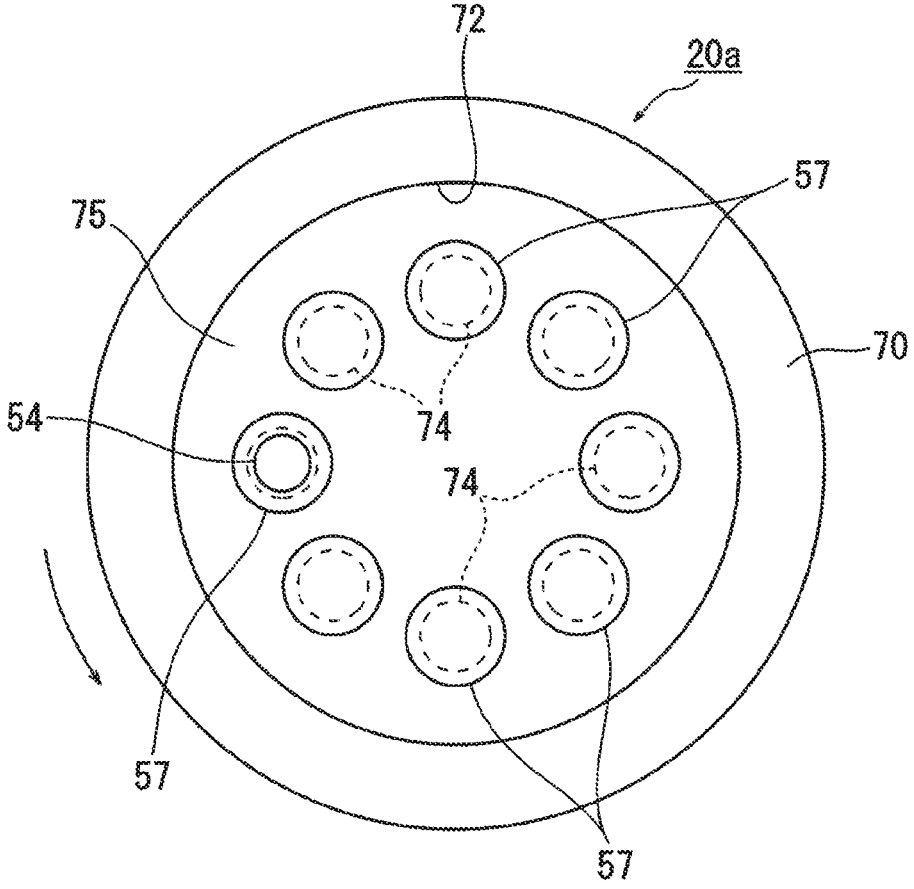
FIG. 3 is a plan view of a modification of a filling device by inserting, cutting and enclosing the metallic sodium in the entire constitution diagram of FIG. 1.

FIG. 3 is a plan view of a modification of the filling device in the entire constitution diagram. In FIG. 3, the filling device 20*a* is a large-diameter cylindrical container with a flange 70. The filling device 20*a* is rotatable in the direction indicated by an arrow in FIG. 3. The filling device 20*a* has an upper opening 72. A cylinder mounting lid 75 having eight cylinder mounting holes 74 in total at equal intervals is fitted with the upper opening 72. Each of the cylinder mounting holes 74 is engaged with a cylinder having the same configuration as in FIG. 1, so that the cylinder mounting holes 74 are engaged with eight cylinders 57 in total. Positioned above one of the eight cylinders 57 is a sodium injection (dripping) nozzle 54 same as in FIG. 1.

In the state of FIG. 3, a predetermined amount of melted metallic sodium is injected (dripped) into the cylinder 57 from the sodium injection (dripping) nozzle 54. As a result, in the same way as in the case of FIG. 1, the predetermined amount of metallic sodium is loaded into the cylinder 57 under directional solidification condition. Thereby, the quantitative filling of the solidified metallic sodium into the first cylinder 57 is completed.

Then, when the filling device 20*a* is rotated by one eighth of the circumference in the direction indicated by the arrow, a second cylinder 57 adjacent to the first cylinder 57 is positioned under the nozzle 54. As in the case of the first cylinder 57, the second cylinder 57 is also filled with the melted metallic sodium. By repeating this operation by eight times in total, the all eight cylinders of the filling device 20*a* can be filled with the metallic sodium.

Figure 4:
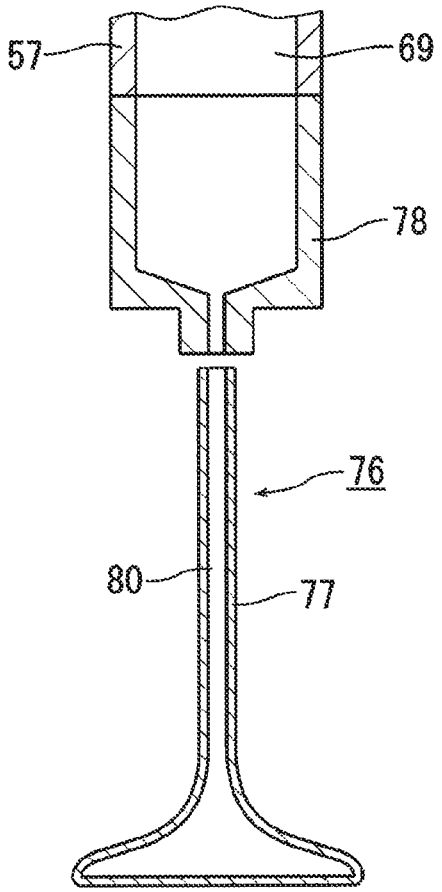
FIG. 4 is a vertical cross-section view of a cylinder in the entire constitution diagram of FIG. 1, illustrating an example in which a nozzle shaped die for injection is attached.

Subsequently, a cap member 56 is detached from the cylinder 57 of FIG. 1 filled with the metallic sodium, preferably while the inert gas atmosphere is maintained. The metallic sodium molding 69 in the cylinder 57 is maintained in a solidified state. As illustrated in FIG. 4, a tapered extrusion nozzle shaped die 78 is mounted on the cylinder 57 in place of the cap member. Then, a hollow engine valve 76 is put under the tip portion of the nozzle shaped die 78 with the stem-side hollow area 77 opening upward. The nozzle shaped die 78 is designed such that the inner diameter of the stem-side hollow area 77 is larger than the tip portion of the nozzle shaped die 78.

When a piston (not shown) is inserted into the cylinder 57 and pressed downward, the metallic sodium molding 69 having a relatively large diameter enters the nozzle shaped die 78. The metallic sodium molding 69 contracts at the tip portion of the nozzle shaped die 78 to be in the form of a line or a wire thinner than the inner diameter of the stem-side hollow area 77. Then, the metallic sodium is introduced into the stem-side hollow area to be inserted and cut with a cutter (not shown) to be enclosed. Thus, the metallic sodium serves as a metallic sodium coolant 82. During introduction into the stem-side hollow area 77, the metallic sodium is formed to be thinner than the inner diameter of the stem-side hollow area 77. Further, the metallic sodium has a uniform structure. Accordingly, the metallic sodium can smoothly pass through the nozzle shaped die 78 to easily enter the stem-side hollow area 77.

EXAMPLES

Hereinafter, Examples will be described. However, the embodiment of the present invention is not limited to the Examples.

Example 1

A melting tank for purifying metallic sodium was configured by connecting a cylindrical container with a bottom which was 250 mm in diameter and 375 mm in height with one end of a pressure-reducing suction pipe at the upper side surface and with one end of a purified-sodium take off pipe and a valve 82 at the lower side surface. Connected to the other end of the pressure-reducing suction pipe was a solvent trap (paraffin trap) filled with liquid paraffin. Connected to the other end of the purified-sodium take off pipe was a reservoir tank for purified metallic sodium. Further, the melting tank was provided with a heater on the bottom surface and the side surface below the pressure-reducing suction pipe of the melting tank.

Then, unpurified metallic sodium immersed in liquid paraffin was purchased and taken off from a storage container. After that, the unpurified metallic sodium was put into the melting tank from an upper opening thereof, a lid to which an inert-gas supply pipe was connected was fastened on the upper round opening to seal the melting tank. Argon gas was supplied into the melting tank from the inert-gas supply pipe, so that internal air in the melting tank was substituted by argon gas.

By activating a pressure-reducing pump connected to the solvent trap and the heater, the pressure in the melting tank was reduced to about −50 kPa and the temperature of the wall of the melting tank was kept at about 200° C., then this condition was maintained for five minutes.

A cylindrical body made of a stainless steel having an inner diameter of 30 mm and a length of 300 mm was prepared. An open bottom of the cylindrical body was sealed with a disc shaped cap member. The cylindrical body was used as a cylinder. The metallic sodium in the melting tank was supplied to the cylinder by injecting the metallic sodium through a supply pipe for the filling device. At the tip of the supply pipe, a sodium injection nozzle was attached. A heater was disposed around the nozzle so as to heat the outer wall of the nozzle. The supply pipe for the filling device was configured in such a way as to increase and reduce the inner pressure to regulate the injection speed.

The outer wall of the nozzle was heated with the heater to about 200° C. The injection speed of the melted metallic sodium was set about 200 g/min. About 1 minutes later, as the cylinder was filled with the metallic sodium, the injection was stopped. After the cylinder was cooled, the metallic sodium which was solidified was taken out of the cylinder and was cut along the horizontal direction with a knife. The cut section was visually checked. However, the metallic sodium had a uniform structure as a whole, and no gaps were observed at all.

Example 2

The metallic sodium purified in the melting tank as in Example 1 was filled in a cylinder under the same condition as in Example 1 except for the inner diameter of the cylinder being set 40 mm. As the metallic sodium was filled in the cylinder, injection was stopped. After the cylinder was cooled, the metallic sodium which was solidified was taken out from the cylinder, and the metallic sodium was cut along the horizontal direction with a knife. The cut section was visually checked. The metallic sodium was uniform as a whole, and no gaps were observed at all.

Example 3

An experiment was performed under the same condition as in Example 2 except for the inner diameter of the cylinder being set to 50 mm. When the horizontal section of the solidified metallic sodium was visually checked, micro gaps with diameters of about 1 mm were observed in a circular portion of about 10 mm in diameter at the center of the circular cross section.

Comparative Example 1

An experiment was performed under the same condition as in Example 2 except for the inner diameter of the cylinder being set to 60 mm. When the horizontal section of the solidified metallic sodium was visually checked, relatively large gaps with diameters of about several millimeters were observed in a circular portion of about 20 mm in diameter at the center of the circular cross section.

Example 4

Filling a cylinder with metallic sodium was performed under the same condition as in Example 2 except for the injection speed being set to 300 g/min, which is faster than that of Example 2. After that, the horizontal section of the solidified metallic sodium was visually checked, the metallic sodium was uniform as a whole and no gaps were observed at all.

Comparative Example 2

Filling a cylinder with metallic sodium was performed under the same condition as in Example 5 except for the injection speed being set to 350 g/min, which is faster than that of Example 5. After that, the horizontal section of the solidified metallic sodium was visually checked. Shadings are found in the whole section and the uniformity was impaired.

DESCRIPTION OF REFERENCE NUMERALS

10 System for purifying and filling metallic sodium
12 Melting tank
14 Solvent trap (paraffin trap)
16 Reservoir tank
18 Cold trap
20, 20*a* Filling device
22 Pressure-reducing suction pipe
24 Purified-metallic-sodium discharge pipe
28 Organic solvent
30 Heater
34 Purified-sodium circulation line
46 Filling device supply pipe
49 Quantitative supply device
54 Sodium dripping nozzle
57 Cylinder
60 Melted metallic sodium
62 Sodium oxide layer
64 Motor
66 Stir bar
69 Metallic sodium molding
76 Engine valve
77 Stem-side hollow area
78 Nozzle shaped die
80 Metallic sodium coolant
$S_1$-$S_5$ Liquid-level detection sensor

The invention claimed is:

1. A method for filling a hollow area of a hollow engine valve with metallic sodium, the method comprising:
injecting melted metallic sodium into a cylinder having a larger diameter than an inner diameter of the hollow area of the engine valve under a directional solidification condition, at a speed faster than a speed at which a droplet solidifies, and in a form in which no discontinuity occurs;
forming a solidified metallic sodium rod having a substantially uniform structure in the cylinder;
inserting metallic sodium into the hollow area of the engine valve through a nozzle shaped die while keeping the uniform structure of the metallic sodium rod;
cutting the inserted metallic sodium; and
sealing the engine valve.

2. The method for filling with metallic sodium according to claim 1, wherein the melted metallic sodium is injected into the cylinder with a boundary of the metallic sodium in the cylinder kept in a semi-solidified condition.

3. The method for filling with metallic sodium according to claim 1, wherein the melted metallic sodium is injected into the cylinder by dripping.

4. The method for filling with metallic sodium according to of claim 1, wherein an inner diameter of the cylinder is within a range of 20 mm to 50 mm, a temperature of the metallic sodium is within a range of 180° C. to 250° C., and an injection speed is within a range of 150 g/min to 300 g/min.

5. A method for purifying metallic sodium including organic solvent and filling a hollow area of a hollow engine valve with purified metallic sodium, the method comprising:
placing metallic sodium in a melting tank which is sealed;
heating the melting tank under reduced pressure to vaporize and remove the organic solvent coating the metallic sodium;
injecting the metallic sodium in a melting state into a cylinder having a larger diameter than an inner diameter of the hollow area of the engine valve under a directional solidification condition, at a speed faster than a speed at which a droplet solidifies, and in a form in which no discontinuity occurs;
forming a solidified metallic sodium rod having a substantially uniform structure in the cylinder;
inserting metallic sodium into the hollow area of the engine valve through a nozzle shaped die while keeping the uniform structure of the metallic sodium rod;
cutting the inserted metallic sodium; and
sealing the engine valve.

6. The method for filling with metallic sodium according to claim 2, wherein the melted metallic sodium is injected into the cylinder by dripping.

7. The method for filling with metallic sodium according to claim 2, wherein an inner diameter of the cylinder is within a range of 20 mm to 50 mm, a temperature of the metallic sodium is within a range of 180° C. to 250° C., and an injection speed is within a range of 150 g/min to 300 g/min.

8. The method for filling with metallic sodium according to claim 3, wherein an inner diameter of the cylinder is within a range of 20 mm to 50 mm, a temperature of the metallic sodium is within a range of 180° C. to 250° C., and an injection speed is within a range of 150 g/min to 300 g/min.

9. The method for filling with metallic sodium according to claim 4, wherein the inner diameter of the cylinder is within a range of 20 mm to 40 mm.

10. The method for filling with metallic sodium according to claim 7, wherein the inner diameter of the cylinder is within a range of 20 mm to 40 mm.

11. The method for filling with metallic sodium according to claim 8, wherein the inner diameter of the cylinder is within a range of 20 mm to 40 mm.

* * * * *